US010661155B2

(12) United States Patent
Martineck, Sr.

(10) Patent No.: US 10,661,155 B2
(45) Date of Patent: May 26, 2020

(54) SCRATCH-OFF LOTTERY TICKET GAME STRUCTURE AND METHOD WITH DYNAMIC VALIDATION FILES TO SUPPORT VARIABLE PRIZE STRUCTURES

(71) Applicant: Scientific Games International, Inc., Newark, DE (US)

(72) Inventor: Jeffrey D. Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 15/915,246

(22) Filed: Mar. 8, 2018

(65) Prior Publication Data

US 2019/0275413 A1 Sep. 12, 2019

(51) Int. Cl.
*G07F 17/32* (2006.01)
*A63F 3/06* (2006.01)

(52) U.S. Cl.
CPC ..... *A63F 3/0665* (2013.01); *G07F 17/329* (2013.01); *G07F 17/3262* (2013.01); *G07F 17/3267* (2013.01); *G07F 17/3218* (2013.01)

(58) Field of Classification Search
None
See application file for complete search history.

(56) References Cited

U.S. PATENT DOCUMENTS 7,153,206 B2 12/2006 Bennett, III
7,416,484 B1 8/2008 Nelson et al.
8,512,123 B2 * 8/2013 Stanek ..... G07F 17/32 463/17
10,249,144 B2 * 4/2019 Irwin, Jr. ..... G07F 17/329
2003/0181235 A1 * 9/2003 Bennett, III ..... G06Q 20/3437 463/17

(Continued)

FOREIGN PATENT DOCUMENTS

WO WO 2013/013299 A1 1/2013

OTHER PUBLICATIONS

EPO Search Report, dated Jun. 4, 2019.

*Primary Examiner* — Ronald Laneau
(74) *Attorney, Agent, or Firm* — Dority & Manning, P.A.

(57) ABSTRACT

An instant lottery ticket game structure and method includes a set of instant lottery tickets, wherein a plurality of these tickets are winning tickets having a predetermined first prize value, as well as a predetermined enhanced second prize value. A validation file stored in a central host computer includes an individual base record for the winning tickets containing ticket identification data and the first prize value. A prize enhancement code on the winning ticket provides an option for the player to opt for the enhanced second prize value at a risk of reducing the first prize value. A sub-record in the validation file is maintained separate from the base record and includes the prize enhancement code and the value of the enhanced second, which may be less than the first prize value. A logic gate in the base record links the sub-record with the base record upon entry of the prize enhancement code by or for the player. For the winning tickets, a single record is created in the validation file by combining the base record with the sub-record upon entry of the prize enhancement code, the single record including a final prize value of the winning ticket.

16 Claims, 3 Drawing Sheets

(56) References Cited

U.S. PATENT DOCUMENTS

| | | | | |
|---|---|---|---|---|
| 2008/0132311 | A1 | 6/2008 | Walker | |
| 2010/0062825 | A1* | 3/2010 | Frick | A63F 3/081 463/17 |
| 2012/0202572 | A1 | 8/2012 | Stanek et al. | |
| 2012/0299241 | A1* | 11/2012 | Frick | A63F 3/081 273/139 |
| 2013/0324212 | A1* | 12/2013 | Frick | A63F 1/04 463/20 |
| 2014/0187305 | A1 | 7/2014 | Irwin, Jr. | |
| 2017/0345252 | A1 | 11/2017 | Martineck, Sr. | |

* cited by examiner

SCRATCH-OFF LOTTERY TICKET GAME STRUCTURE AND METHOD WITH DYNAMIC VALIDATION FILES TO SUPPORT VARIABLE PRIZE STRUCTURES

BACKGROUND

The lottery or gaming industry is continuously seeking methods to enhance the gaming experience for players, as well as to increase the benefit for participating retail establishments that sell lottery tickets.

Scratch-off ("instant") lottery tickets are a mainstay of the lottery industry and are quite popular among players. However, the conventional paper-based and simulated electronic scratch-off tickets have been in use for quite some time and the industry is continuously seeking ways to enhance the tickets and game playing experience so as to continue to attract new players. Such enhancements are, however, limited by the essentially "static" nature of the prize structures associated with such tickets dictated by the security requirements of the associated ticket validation files.

In conventional scratch-off lottery ticket systems, especially those in the United States that are administered by state governments, each winning ticket (or all tickets) is printed with a validation number or code that identifies and links the ticket to a validation file stored in a central host computer maintained by the game administrator, the validation file containing the redemption value of the ticket. Winning tickets are presented by players to lottery agents for redemption, wherein the agent enters ticket identification or validation data from the ticket into an agent terminal using a bar code reader or manually inputting this data. This information is then transmitted to the host computer at the state lottery administration and is used to access the validation file. Typically, there is one record in the validation file for each such winning ticket that contains the redemption value of the ticket. The redemption value is transmitted to the lottery terminal and if the transmitted value matches the printed winning value on the lottery ticket, the agent will pay the prize amount to the player.

Similarly, in certain electronic lottery systems, winning eTicket vouchers are presented by players to lottery agents or lottery validation systems for redemption. In many cases, in particular where the eTicket has a high value, the lottery agent or system will transfer eTicket identification or validation data from the eTicket into an agent terminal via a bar code or by manually inputting this data. This information is then transmitted to the host computer at the state lottery administration where and used to access the validation file, in particular the record in the validation file for such winning eTicket that contains the redemption value of the ticket. This redemption value is then transmitted to the agent terminal and if the transmitted redemption value matches the printed winning value on the voucher, the agent will pay the prize amount to the player.

With such conventional systems, the validation file contains a fixed or static prize value for all tickets that contain a winning prize value. However, while maintaining a static prize value for each ticket in the validation file has been considered desirable from a security standpoint, maintaining the static value reduces the flexibility of lottery administrations to create new types of games and to compensate for various problems such as the problem described above.

U.S. Pat. No. 7,153,206 proposes a system and method wherein provision is made for the instant lottery tickets to have variable redemption values by allowing the prize codes in the validation file to be changed under certain predetermined circumstances. At least some of the lottery tickets in the game, whether printed or electronically simulated, are provided with play indicia under a scratch-off coating that indicates that the redemption value of that lottery ticket is variable under certain predetermined criteria. Using the host computer, personnel at the lottery administration can change the prize codes and therefore the redemption value of these instant lottery tickets according to the predetermined criteria (such as the termination of a game). A player can have the option to redeem an instant lottery ticket for a first value or wait until after termination of the game where a possibly higher redemption value might be assigned to that ticket due to the host computer randomly selecting that ticket to change its prize code to a greater value.

Although the '206 patent suggests a means to provide a variable prize structure to instant lottery ticket game structures, the proposed solution relies on eventual human intervention and modification of the validation file. This aspect is undesirable from a security aspect.

The present invention seeks methods and game structures that allow a variable prize structure for instant lottery ticket games yet preserves security of the validation file structure.

SUMMARY

Objects and advantages of the invention will be set forth in part in the following description, or may be obvious from the description, or may be learned through practice of the invention.

In a particular embodiment, an instant lottery ticket game structure is provided that comprises a set of instant lottery tickets (i.e., scratch-off lottery tickets). A plurality of the instant lottery tickets in the set are winning tickets that have a positive (greater than zero) predetermined first prize value. Game play indicia is provided on the ticket and is covered by a scratch-off coating. A player removes the scratch-off coating from the game play indicia to reveal the winning status of the ticket and the first prize value.

The instant lottery tickets may be printed paper tickets, or may be electronically simulated tickets that are transmitted to and played by the player via an application running on a smart device, such as a mobile phone, tablet, computer, etc.

One or more of the winning tickets in the set has a predetermined enhanced second prize value assigned thereto that is greater than the first prize value. For example, the enhanced prize value may be a multiplier (e.g., 2× or 3×) of the first prize value.

An electronic validation file is created for the set of instant lottery tickets and is stored in a central host computer, which is typically maintained by the lottery administrator of lottery service provider. The validation file includes an individual base record for at least each winning ticket, and may include a base record for every ticket in the set (including the non-winning tickets). The base record includes ticket identification data contained in the validation code on the ticket and the predetermined first prize value assigned to the winning ticket.

The winning tickets are specifically modified to have a prize enhancement code provided thereon. This code may alpha-numeric or contained in a bar code format that is unique to each ticket. Alternatively, the prize enhancement code may be generic to all of the winning tickets, for example, akin to a "yes" or "positive" symbol on each ticket that simply reflects the player's decision to opt for the enhanced prize. Whether unique to the ticket or generic, the prize enhancement code is a device that provides an option to the player to opt for the enhanced second prize value that may be assigned to their particular winning ticket. This option has the risk, however, of reducing the first prize value, which includes a complete loss of the first prize value. For example, the player may opt for the enhanced second prize value in the hopes of doubling the first prize value, but the ticket may not have an enhanced second prize value assigned thereto, and the player would lose all or some of the first prize value as the "cost" for playing the option.

The prize enhancement code may also be contained in the validation file base record for the winning ticket.

For at least the winning tickets, a sub-record is created at the same time the base records are created in the validation file. The sub-record is, however, maintained separate from the base record in the validation file. The sub-record includes the prize enhancement code and the enhanced second prize value assigned to the winning ticket (if any). The sub-record may also include a reduced first prize value if the game is structured so that the player does not lose the entire first prize value if there is no enhanced second prize value assigned to the ticket.

A logic gate in the base record is activated upon entry of the prize enhancement code to the host computer (e.g. entered by the lottery agent scanning the code from the winning ticket). Once activated, this logic gate links (i.e., attaches) the sub-record to the base record for the particular winning ticket. Thus, for winning tickets wherein a final prize value may change depending on whether or not the player opts for the enhanced prize value, a single record is created in the validation file for the ticket by combining the base record with the sub-record upon entry of the prize enhancement code, the single record including the final prize value of the winning ticket. The sub-record may include a final prize value that is greater than the first prize value (e.g., by a multiplier factor of 2× or 3×), a final prize value of zero, or a final prize value that is less than the first prize value (e.g. one-half of the first prize value).

With the above game structure and method, the validation file is "dynamic" is that it the individual ticket records contained therein are automatically changed or updated to reflect the changing prize value of any of the instant lottery tickets in the set. For accounting, confirmation, and any other post-sale reason, the validation file accurately reflects the final value of the tickets in the set. This is accomplished without the need of personnel intervention or access to the validation file.

In a particular embodiment of the instant lottery ticket game structure, at a defined section of the ticket, the prize enhancement code is covered by a scratch-off coating on the instant lottery tickets, wherein the player removes the scratch-off coating and presents the prize enhancement code to the central host computer (e.g. via a lottery agent for transmission to the host computer, or by transmission via the player's smart device for electronic ticket embodiments). In a certain embodiment, the losing lottery tickets in the set may also include simulated prize enhancement code in the form of a scratch-off coating over a generic indication that the ticket is a losing ticket in the defined section of the ticket so that winning and losing tickets are indistinguishable to the player prior to purchase and play of the ticket.

The game structure may include a unique means of revealing the outcome of the enhanced prize option to the player. For example, the game structure may include a computer application enabled on a smart device operated by the player (e.g. a smart phone, tablet, PDA, computer, etc.), wherein results of entry of the prize enhancement code are revealed to the player via the smart device upon entry of a code by the player. This code may be provided on the winning ticket, for example along with the prize enhancement code under the scratch-off coating, or may be the prize enhancement code. Alternatively, the code may be generated and given to the player when the prize enhancement code is entered by the lottery agent at a terminal. For example, the terminal may print off a receipt having the code thereon, wherein the receipt is then handed to the player.

The present invention also encompasses various method embodiments for implementing an instant lottery ticket game in accordance with certain aspects discussed above. For example, a particular embodiment includes providing a set of instant lottery tickets (paper or electronic tickets), and designating a plurality of the instant lottery tickets as winning tickets that have a positive predetermined first prize value assigned thereto, which is revealed to a player by removal of a scratch-off coating (actual or simulated) from over prize indicia provided on the winning ticket. The method includes designating one or more of the winning tickets to have a predetermined enhanced second prize value assigned thereto.

Prior to distribution of the instant lottery tickets for sale, a validation file is created and stored in a central host computer, the validation file including an individual base record for at least each of the winning tickets. This base record includes ticket identification data and the predetermined first prize value for the winning ticket.

Each of the winning tickets is configured with a prize enhancement code (unique to the ticket or generic to the winning tickets) that permits the player to opt for the enhanced second prize value that may be assigned to the winning ticket. This option comes at a risk to the player of reducing the first prize value (including losing the entire first prize value). The prize enhancement code is also contained in the validation file base record for the winning ticket.

At least for the winning tickets and when creating the base record, the method includes creating a sub-record in the validation file associated with the base record and maintained separate from the base record in the validation file. This sub-record includes the prize enhancement code and the enhanced second prize value or reduced first prize value.

The method includes configuring the base record with a logic gate that links the sub-record with the base record in the validation file upon entry of the prize enhancement code by or for the player. In other words, when the player with a winning ticket opts for the enhanced prize possibility and the prize enhancement code is transmitted to the central host computer, a computer process first checks that the ticket validation code or number transmitted for the ticket identifies a winning ticket and that the prize enhancement code is valid for the winning ticket. If so, the digital logic gate in the base record is activated ("opens") to automatically link the sub-record with the base record. This is necessary because the final prize award for the ticket will change (up or down) once the player opts for the enhanced prize and the enhanced prize code is transmitted. The final prize code must be reflected in the validation file record for the particular ticket. Thus, a single record is created in the validation file by combining the base record with the sub-record upon entry of the prize enhancement code, the single record including a final prize value of the winning ticket.

In a particular method embodiment, the prize enhancement code is covered by a scratch-off coating on the instant lottery tickets (actual for paper tickets or electronically simulated for electronic tickets), wherein the player removes the scratch-off coating and presents the prize enhancement code to a lottery agent for transmission to the central host computer, or transmits the code via a player smart device.

The method may include creating the base record in the validation file for only winning instant lottery tickets, or for each ticket (winning or losing) in the set of instant lottery tickets. The method may further include configuring each of the instant lottery tickets in the set of instant lottery tickets with a prize enhancement code thereon, and wherein the prize enhancement code is only valid or active for the winning tickets. All of the tickets may have these prize enhancement codes covered by a scratch-off material in a defined "prize enhancement section" of the lottery ticket so that all tickets in the set have the same initial appearance to the players.

The enhanced prize aspect of the method can vary. In one embodiment, the enhanced prize value is a multiple of the first prize value, and the reduced first prize value is a total loss of the first prize value.

As discussed above, the method may include a unique means of revealing the outcome of the enhanced prize option to the player. For example, the game structure may include a computer application enabled on a smart device operated by the player (e.g. a smart phone, tablet, PDA, computer, etc.), wherein results of entry of the prize enhancement code are revealed to the player via the smart device upon entry of a code by the player. This code may be provided on the winning ticket, for example along with the prize enhancement code under the scratch-off coating, or may be the prize enhancement code. Alternatively, the code may be generated and given to the player when the prize enhancement code is entered by the lottery agent at a terminal. For example, the terminal may print off a receipt having the code thereon, wherein the receipt is then handed to the player.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Generally, the present disclosure is directed to a computer-based instant lottery ticket game structure and associated method (indicated generally as "60" in FIG. 3) of operation that utilize a dynamic validation file configuration to provide increased flexibility to game features and prize structures without comprising security of the validation file.

It is typical practice in the United States lottery industry for a ticket vendor (who may also be the game service provider for the lottery authority) to provide a state lottery authority with one or more sets of instant lottery tickets, where each set is defined as a game. Each game will normally have a prize structure with a predetermined number of winning tickets and a predetermined number of losing tickets structured to achieve the expected value of the game. Very often, the winning tickets are divided between high tier winners, which have a high winning prize value (and lesser odds of winning) and low tier winners that have relatively low winning values (and greater odds of winning). This initial prize structure is referenced herein as a "first prize value" with respect to the individual tickets.

Figure 1A:
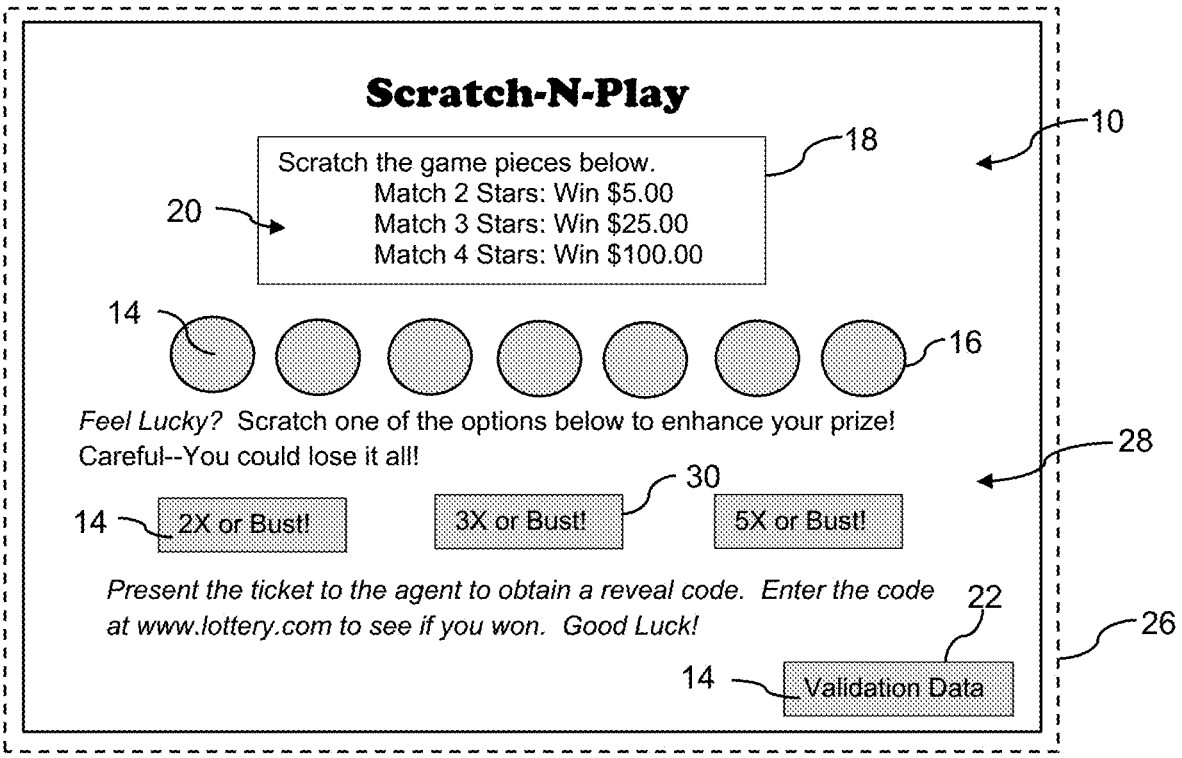
FIG. 1*a* depicts an instant scratch-off lottery ticket that may be used with the game structure and methods according to an exemplary embodiment of the present invention.
Figure 1B:
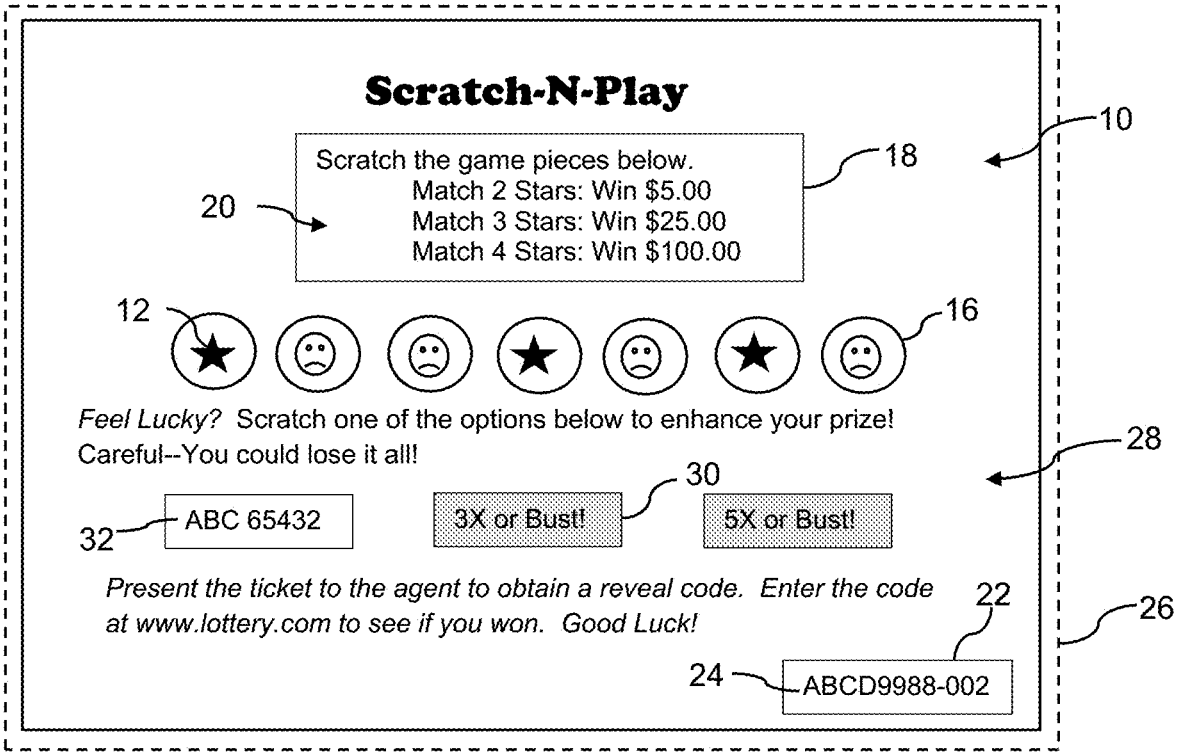
FIG. 1*b* depicts the instant scratch-off lottery ticket of FIG. 1*a* after being played.
Figure 1C:
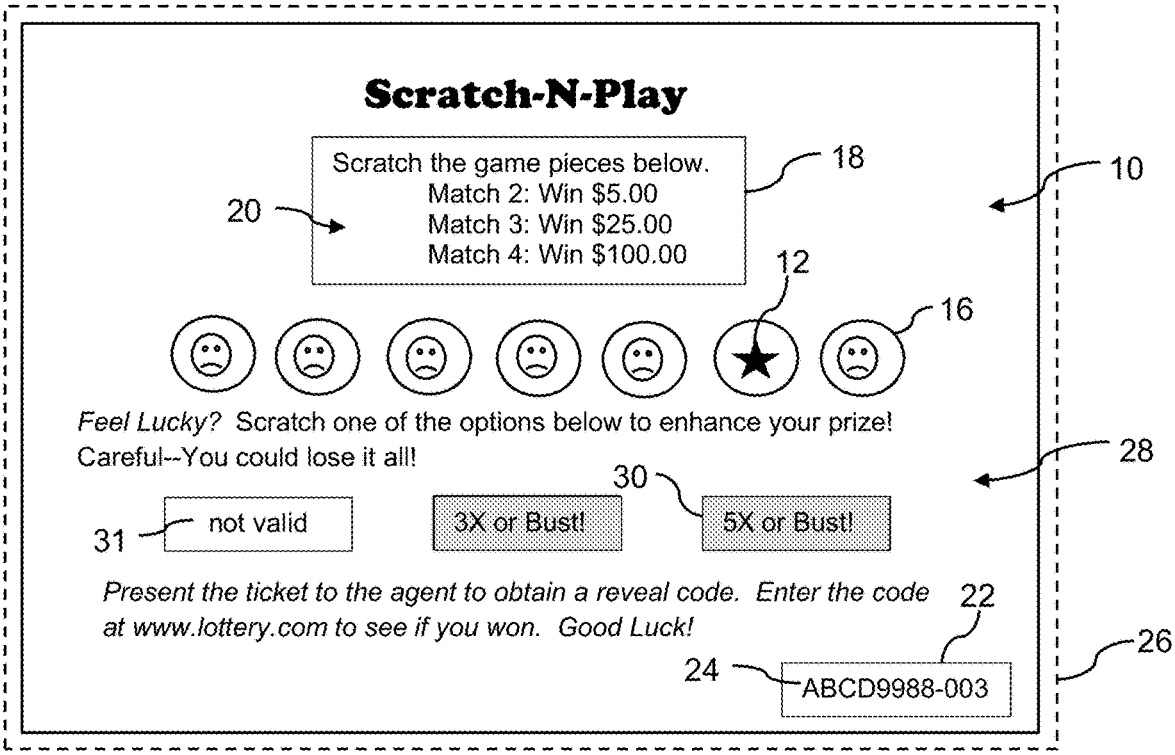
FIG. 1*c* depicts an instant scratch-off lottery ticket that is revealed to be a non-winner in the initial play of the ticket.

Referring to FIGS. 1*a*-1*c*, aspects of the instant lottery ticket game structure and method include a set or production run of instant lottery tickets 10 (i.e., scratch-off lottery tickets). As is well understood and mentioned above, a game set of such tickets 10 has a prize structure and odds distribution to achieve an "expected value" for the lottery authority. In this regard, a plurality of the instant lottery tickets 10 in the set are winning tickets that have a positive (greater than zero) predetermined first prize value. For example, the ticket 10 in FIG. 1 a has a potential first prize value of $5, $25, or $100, as indicated by the prize value indicia 20. As with conventional instant lottery tickets, game play indicia 12 that reveals the win/loss outcome of the ticket 10 are provided at play spots 16 that are covered by a scratch-off coating 14. A player removes (i.e., scratches-off) the scratch-off coating 14 from the play spots 16 to reveal the game play indicia 12 and the status of the ticket, as well as the first prize value (if any).

The instant lottery tickets 10 may be printed paper stock tickets, or may be electronically simulated tickets that are transmitted to and played by the player via an application running on a smart device 50 (FIG. 3), such as a mobile phone, tablet, computer, etc., wherein a simulated scratch-off coating 14 covers the game play indicia 12. The dashed outline of the tickets 10 in FIGS. 1*a*-1*c* depict screen 26 or other display of the player's smart device that is connected to a central host computer 42 (FIG. 3) to obtain/download the electronic ticket. The simulated scratch-off coating 14 can be removed by the player by operation of a mouse or some other control device connected or operable with the smart device 50.

Each lottery ticket 10 also includes validation data in the form of a validation code 24, which may be in the form of a barcode or alpha-numeric form, at a validation spot 22 on the ticket and covered by a scratch-off coating 14. As known in the industry, the validation code 24 contains ticket identification data that links the ticket to a record in a validation file stored in a host computer (discussed in greater detail below).

Evenly dispersed throughout the set of game tickets 10 will be one or more of the winning tickets (predetermined tickets that have one of the first prize values assigned thereto) that also has a predetermined enhanced second prize value assigned thereto that is greater than the first prize value. For example, the enhanced prize value may be a multiplier (e.g., 2× or 3×) of the first prize value. The number and prize distribution of these tickets is also computed so that, even if all of such enhanced prizes are distributed, the game still achieves its expected value.

At least the winning tickets 10 in the set of game tickets are specifically modified to have a prize enhancement code 32 provided thereon, referring to FIGS. 1*a* and 1*b*. This code 32 may be alpha-numeric or contained in a bar code format. In a particular embodiment, the prize enhancement code 32 is unique to each ticket 10. Alternatively, the prize enhancement code 32 may be generic to all of the winning tickets, for example, akin to a "yes" or "positive" symbol on each ticket 10 that simply reflects the player's decision to opt for the enhanced prize, as explained in greater detail below. Whether unique to the ticket or generic, the prize enhancement code 32 is a device that provides an option to the player to opt for the enhanced second prize value that could potentially be assigned to their particular winning ticket 10 and that could significantly increase their winnings. This option has the risk, however, of reducing the first prize value, which includes a complete loss of the first prize value. For example, the player may opt for the enhanced second prize value in the hopes of doubling the first prize value, but the result could actually be a reduction or complete loss of the first prize value, and the player would lose all or some of the first prize value as the "cost" for playing the option.

In the ticket 10 of FIGS. 1*a* and 1*b*, there are three enhanced prize options presented to the player in the event that the ticket 10 wins one of the first prize values. The multiple enhanced prize options are presented at game enhancement spots 30, wherein each spot 30 includes a game enhancement code 32 covered by a scratch-off coating 14. One of the spots 30 allows for the player to opt for a 2× multiplier of the first prize value at the risk of going "bust" (losing the first prize value). Other spots 30 allow for the player to opt for 3× and 5× multipliers (also with the chance of going bust), respectively.

FIGS. 1*a* and 1*b* reflect that the ticket 10 is a winner of the first prize value in the amount of $25 (three matching stars), and that the player has opted for the 2× enhanced prize value by removing the scratch-off coating 14 from the "2×" spot 30 to reveal the underlying prize enhancement code 32. As explained below with reference to FIG. 3, this code 32 is transmitted to a central host computer 42 in accordance with aspects of the present structure and method.

Figure 2:
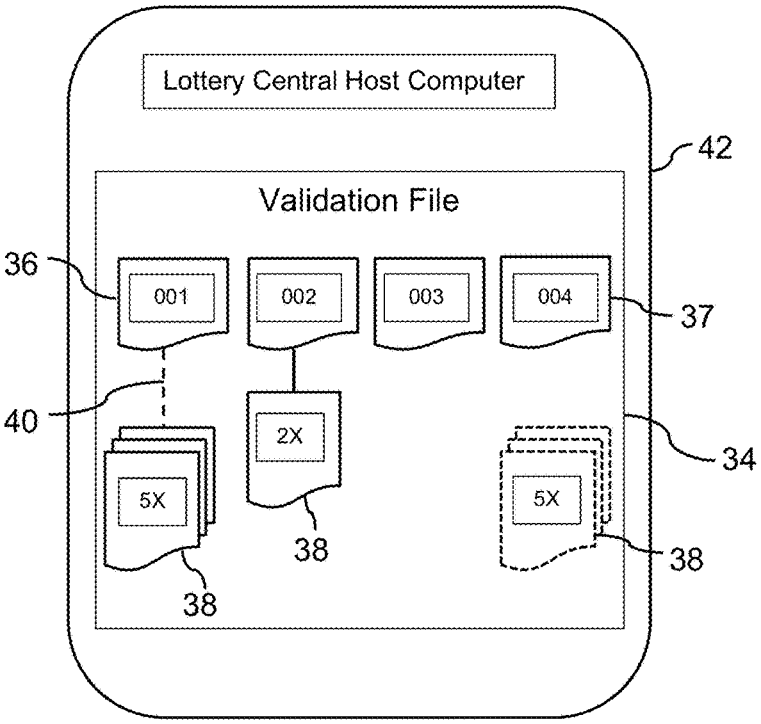
FIG. 2 is a block diagram of a validation file configured in accordance with aspects of the present invention.
Figure 3:
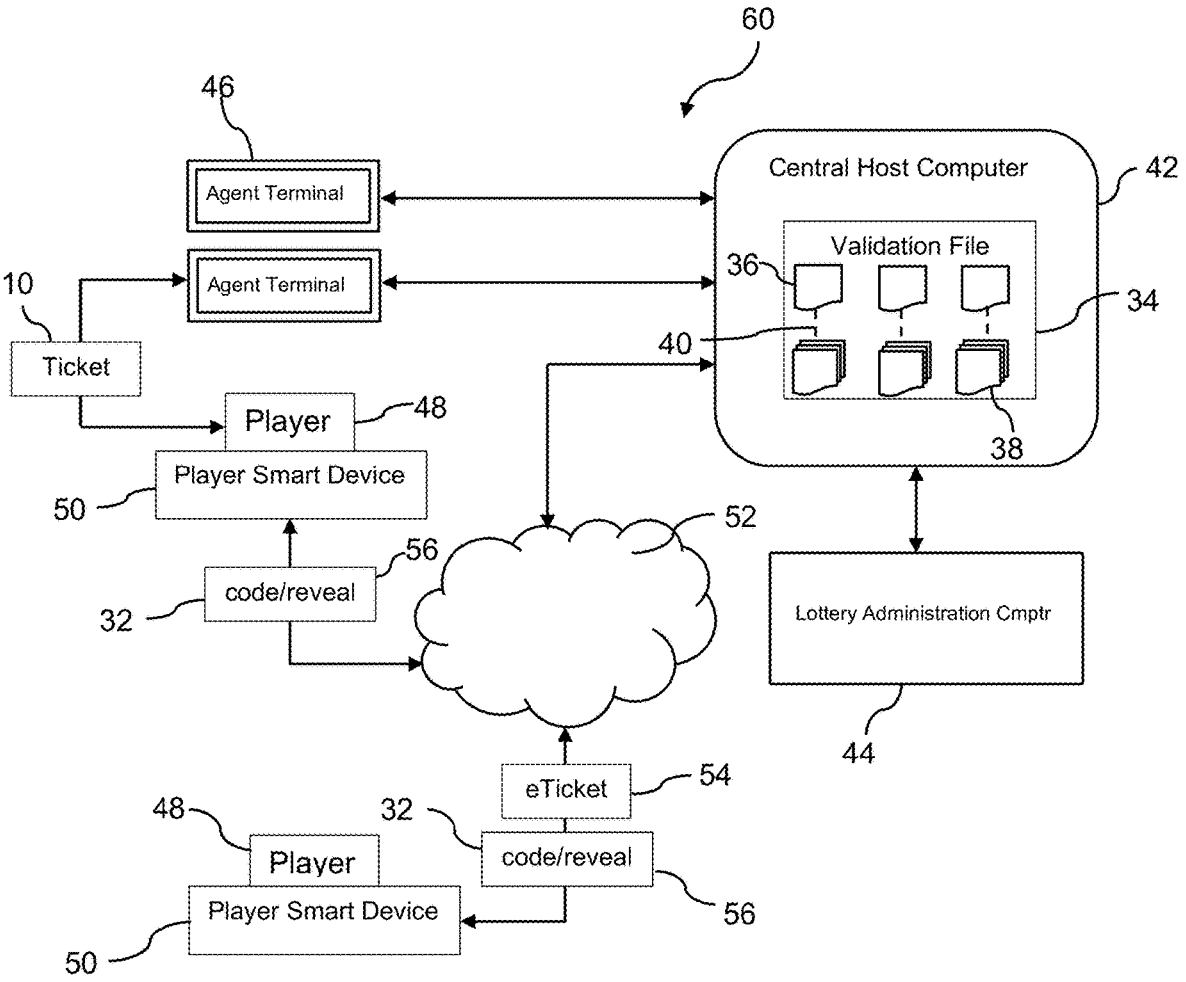
FIG. 3 is a block diagram of a lottery ticket game structure and associated method.

Referring to FIGS. 2 and 3, it is industry practice for the ticket vendor to supply a validation file 34 for each game, which is generally structured to contain a base record 36 for at least each winning ticket 10 in the game set. This base record 36 contains the prize code or predetermined redemption value for each winning ticket in the game. In conventional game structures, the prize value represented by the prize code in each record 36 provided by the vendor is fixed or static. For some games, the validation file 34 will contain a respective record 36 for only the winning tickets 10 in the game set. However, in other embodiments, the validation file can contain a record 36 for each ticket 10 in the game. This vendor-supplied validation file 34 is then loaded into a central host computer 42 used by the entity that services the game for the lottery authority using appropriate data input means.

In many state lotteries in the U.S., the practice is to require that at least the high tier lottery tickets 10 presented by a player to a lottery agent for redemption be validated by having the lottery agent transmit ticket the validation code 24 from an agent terminal 46 to the host computer 42. This information is then used to access the base record 36 in the validation file 34 that contains the prize code or redemption value for the lottery ticket 10, and this value is then transmitted back to the agent terminal 46. The usual practice is to have the lottery agent compare this value from the host computer 42 with the winning first prize value printed on the lottery ticket 10 and if they are the same, the agent will pay the player this amount or provide the player with a form that he can use to redeem the ticket from the lottery administration.

For purposes of the present game structure and method, the prize enhancement code(s) 32 may also be contained in the validation file base record 36 for each winning ticket 10.

Still referring to FIGS. 3 and 4, for at least the winning tickets 10 in the game set, a sub-record 38 is created at the same time the base records 36 are created in the validation file 34. The sub-record 38 is, however, maintained separate from the base record 36 in the validation file 34 to the extent that the information in the sub-record 38 that relates to the enhanced prize value assigned to the ticket is not made part of the base record 36 unless a series of events occurs, as described below. The sub-record 38 includes the prize information linked to the prize enhancement code 32 and the enhanced second prize value assigned to the winning ticket 10 (if any). The sub-record 38 may also include a reduced first prize value if the game is structured so that the player does not lose the entire first prize value in the event there is no enhanced second prize value assigned to the ticket.

Referring to FIG. 2, it is depicted that a ticket 10 identified with the validation data "001" has three sub-records 38 associated therewith (corresponding to one sub-record 38 for each of the 2×, 3×, and 5× prize enhancement options). The respective sub-record 38 corresponding to the player's selection may include a final prize value that is greater than the first prize value (e.g., by a multiplier factor of 2× or 3×), a final prize value of zero, or a final prize value that is less than the first prize value (e.g. one-half of the first prize value). The sub-records 38 are associated with the base record 36 by a digital logic gate depicted by the dashed line 40. This particular ticket identified as 001 has not yet been played (or at least not yet redeemed). The logic gate 40 in the base record 36 is activated upon entry of the prize enhancement code 32 to the host computer 42 (e.g. entered by the lottery agent scanning the validation code 24 and then the prize enhancement code 32 from the winning ticket 10). Once activated, this logic gate 40 "links" (i.e., attaches) the particular sub-record 38 associated with the prize enhancement code 32 to the base record 36 for the particular winning ticket 10.

Thus, for winning tickets 10 wherein a final prize value may change depending on whether or not the player opts for the enhanced prize value, a single record 37 (see FIG. 4 with respect to the ticket identifier "004") is created in the validation file 34 for the ticket 10 by combining the base record 36 with the sub-record 38 upon entry of the prize enhancement code 32, the single record 37 including the final prize value of the winning ticket (which may be the enhanced prize value, a reduced first prize value, or no prize value).

The winning ticket 10 in FIG. 1*b* includes three prize enhancement options (and thus three separate prize enhancement codes 32). For purposes of illustration, this ticket 10 is identified in the validation code 24 by the last three digits "002". The ticket has a first prize value of $25 and the player has opted for the 2× prize enhancement by removing the scratch-off coating 14 from the 2× spot 30 to reveal the prize enhancement code 32 (which is scanned and transmitted to the central host computer 42). In FIG. 2, the digital logic gate 40 has been activated and links the 2× sub-record 38 to the base record 36 for this ticket. The enhanced prized value information contained in the sub-record 38 will then be merged with the based record 36 to create the final record 37.

With the above game structure and method 60, the validation file 34 is "dynamic" is that it the individual ticket base records 36 contained therein are automatically changed or updated to reflect the changing prize value of any of the instant lottery tickets 10 in the set. For redemption, accounting, confirmation, and any other post-sale reason, the validation file 34 accurately reflects the final value of the tickets 10 in the set. This is accomplished without the need of personnel intervention or access to the validation file.

Referring to FIG. 1*c*, in a certain embodiment, the losing lottery tickets 10 in the set may also include one or more simulated prize enhancement codes in the form of a scratch-off coating 14 over a generic indication 31 that the ticket is a losing ticket in the defined prize enhancement section 28 of the ticket so that winning and losing tickets 10 are indistinguishable to the player prior to purchase and play of the ticket 10. FIG. 2 represents that a base record 36 is created in the validation file 34 for each losing ticket as well, but there are no sub-records 38 associated with the losing tickets 10. In an alternative embodiment, sub-records 38 may also be created for each losing ticket 10 for sake of sameness in the file structure, but are inactive. For example, the digital logic gate function may not be provided in the base records 36, which would prevent lining of a sub-record 38.

Referring to FIG. 3, the game structure and method 60 may include a unique means of revealing the outcome of the enhanced prize option to the player 48. For example, the game structure 60 may include a computer application enabled on a smart device 50 operated by the player 48 (e.g. a smart phone, tablet, PDA, computer, etc.), wherein results of entry of the prize enhancement code are revealed to the player via the smart device 50 upon entry of a reveal code or other message by the player 48 to central host computer 42 via any suitable communications network 52. This reveal code may be provided on the winning ticket 10, for example as a separate code, or along with the prize enhancement code 32 under the scratch-off coating. The prize enhancement code 32 may also function as the reveal code (particularly if there are multiple possible enhanced prize opportunities presented on a single ticket, as in the embodiment depicted in the figures). Alternatively, the code may be generated and given to the player when the prize enhancement code 32 is entered by the lottery agent at a terminal 46. For example, the terminal 46 may print off a receipt having the reveal code thereon, wherein the receipt is then handed to the player 48. Once the code request is received by the host computer 42, a reveal message 56 is generated and transmitted back to the player's smart device 50. This reveal message 56 will indicate the final prize value for the player's winning ticket after exercise of the enhanced prize option by the player, as well as instructions as to how the player can redeem the prize.

FIG. 3 also depicts the electronic ticket 54 version of the structure and method 60 wherein the electronic simulated scratch-off ticket 54 is transmitted to the player's smart device 50 for play. If the ticket 54 is a winning ticket, the player 48 can then opt for one of the enhanced prize options on the ticket 54 by transmitting the request code (which may be the actual game enhancement code 32). The reveal message 56 will then be generated and transmitted back to the player's smart device 50.

It should be appreciated that the host computer 42 (e.g., a game server) can include a network interface for providing communications over the network 52. A network interface can include any suitable components for interfacing with one more networks, including for example, transmitters, receivers, ports, controllers, antennas, or other suitable components.

The host computer 42 can be any computing device and can include one or more processors and one or more computer-readable media. The computer-readable media can store instructions which cause the processor to perform the operations described herein, as well as other functions related to conduct of the overall game for the lottery authority.

The player's smart device 50 can be any portable computing device that can be used by a player to interface with the host computer 42. For instance, the device 50 can be a wireless device, a personal digital assistant (PDA), portable gaming device, cellular phone, smart phone, tablet, navigation system, handheld GPS system, wearable computing device, a display having one or more processors, or other such device. In short, the player device 50 can be any computer-device or system that can execute a gaming module to allow a player to interact with the host computer 42 as described herein.

The network 52 can be any type of communications network, such as a local area network (e.g. intranet), wide area network (e.g. Internet), or some combination thereof. The network can also include a direct connection between a player mobile device 50 and the host computer 42. In general, communication between the host computer 42 and player mobile device 50 can be carried via a network interface using any type of wired and/or wireless connection, using a variety of communication protocols (e.g. TCP/IP, HTTP, SMTP, FTP), encodings or formats (e.g. HTML, XML, JSON), and/or protection schemes (e.g. VPN, secure HTTP, SSL).

FIG. 3 also depicts a lottery authority administrative computer 44 interfaced with the central host computer 42 for any manner of functions, including receipt of reports generated by the game service provider based on the modifications and changes made to the base records in the dynamic validation file 34 as described herein.

The technology discussed herein makes reference to servers, computers, databases, software applications, and other computer-based systems, as well as actions taken and information sent to and from such systems. One of ordinary skill in the art will recognize that the inherent flexibility of computer-based systems allows for a great variety of possible configurations, combinations, and divisions of tasks and functionality between and among components. For instance, server processes discussed herein may be implemented using a single server or multiple servers working in combination. Databases and applications may be implemented on a single system or distributed across multiple systems. Distributed components may operate sequentially or in parallel.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An instant lottery ticket game structure system, comprising:

a set of instant lottery tickets, the lottery tickets comprising printed paper tickets or electronically simulated tickets displayed on a player's smart device, wherein a plurality of the instant lottery tickets are winning tickets that have a positive predetermined first prize value that is revealed to a player by removal of a scratch-off coating on the printed tickets or simulated on the electronically simulated tickets from over prize indicia printed or displayed on the winning tickets;

one or more of the winning tickets having a predetermined enhanced second prize value assigned thereto;

an electronic validation file stored in a central host computer, the validation file including an individual base record for at least each of the winning tickets, the base record including ticket identification data and the predetermined first prize value for the winning ticket;

a prize enhancement code printed or electronically displayed on each of the winning tickets that permits the player to opt for the enhanced second prize value that may be assigned to the winning ticket at a risk of reducing the first prize value, the prize enhancement code also stored electronically in the base record for the winning ticket;

at least for the winning tickets, a sub-record stored electronically in the validation file that is maintained separate from the base record, the sub-record including the prize enhancement code and the enhanced second prize value or reduced first prize value;

a computer logic gate in the base record that links the sub-record with the base record upon entry of the prize enhancement code by or for the player; and wherein, for the winning tickets, a single record is electronically created and stored by the central host computer in the validation file by combining the base record with the sub-record upon entry of the prize enhancement code, the single record including a final prize value of the winning ticket.

2. The instant lottery ticket game structure system of claim 1, wherein the prize enhancement code is covered by a scratch-off coating on the printed tickets or simulated on the electronically simulated instant lottery tickets, wherein the player removes the scratch-off coating and the prize enhancement code is transmitted to the central host computer.

3. The instant lottery ticket game structure system of claim 1, wherein the validation file includes a base record for each of the instant lottery tickets in the set of instant lottery tickets.

4. The instant lottery ticket game structure system of claim 3, wherein each of the instant lottery tickets in the set of instant lottery tickets includes a prize enhancement code provided thereon, and wherein the prize enhancement code is only active for the winning tickets.

5. The instant lottery ticket game structure system of claim 1, wherein the enhanced prize value is a multiple of the first prize value, and the reduced first prize value is a total loss of the first prize value.

6. The instant lottery ticket game structure system of claim 1, further comprising a computer application enabled on a smart device operated by the player, wherein results of entry of the prize enhancement code are revealed to the player via the smart device upon entry of a code by the player.

7. The instant lottery ticket game structure system of claim 6, wherein the code entered by the player is provided on the winning ticket.

8. The instant lottery ticket game structure system of claim 6, wherein the code entered by the player is generated and given to the player when the prize enhancement code is entered.

9. A method for implementing an instant lottery ticket game with a central host computer linked t instant lottery tickets by codes printed or electronically, displayed on the instant lottery tickets, comprising:

providing a set of the instant lottery tickets as printed paper tickets or electronically simulated tickets on a player's smart device, including designating a plurality of the instant lottery tickets as winning tickets that have a positive predetermined first prize value assigned thereto that is revealed to a player by removal of a scratch-off coating on the paper tickets or simulated on the electronically simulated tickets from over prize indicia provided on the winning tickets;

designating one or more of the winning tickets to have a predetermined enhanced second prize value assigned thereto;

prior to distribution of the instant lottery tickets for sale, creating an electronic validation file and storing the validation file in the central host computer, the validation file including an individual base record for at least each of the winning tickets, the base record including ticket identification data and the predetermined first prize value for the winning ticket;

configuring at least each of the winning tickets with a prize enhancement code printed or electronically displayed thereon that permits the player to opt for the enhanced second prize value that may be assigned to the winning ticket at a risk of reducing the first prize value, the prize enhancement code also stored electronically in the validation file record for the winning ticket;

at least for the winning tickets and when creating the base record, creating an electronic sub-record in the validation file associated with the base record and maintained separate from the base record in the validation file, the sub-record including the prize enhancement code and the enhanced second prize value or reduced first prize value;

configuring the base record with a computer logic gate that links the sub-record with the base record upon entry of the prize enhancement code by or for the player; and wherein, for the winning tickets, with the central host computer, electronically creating and storing a single record in the validation file by combining the base record with the sub-record upon entry of the prize enhancement code, the single record including a final prize value of the winning ticket.

10. The method of claim 9, wherein the prize enhancement code is covered by a scratch-off coating on the printed tickets or simulated on the electronically simulated tickets instant lottery tickets, and wherein the player removes the scratch-off coating and the prize enhancement code is transmitted to the central host computer.

11. The method of claim 9, wherein the validation file is created to include a base record for each of the instant lottery tickets in the set of instant lottery tickets.

12. The method of claim 11, wherein each of the instant lottery tickets in the set of instant lottery tickets is configured with a unique prize enhancement code thereon, and wherein the prize enhancement code is only active for the winning tickets.

13. The method of claim 9, wherein the enhanced prize value is a multiple of the first prize value, and the reduced first prize value is a total loss of the first prize value.

14. The method of claim 13, further comprising providing a computer application that is enabled on a smart device operated by the player, wherein results of entry of the prize enhancement code are revealed to the player via the smart device upon entry of a code by the player.

15. The method of claim 14, wherein the code entered by the player is provided on the winning ticket.

16. The method of claim 14, wherein the code entered by the player is generated and give to the player when the prize enhancement code is entered.

* * * * *